United States Patent [19]

Hughes

[11] 4,189,101

[45] * Feb. 19, 1980

[54] STABLE VORTEX GENERATING DEVICE

[76] Inventor: Nathaniel Hughes, 1934 Sonara Rd., Palm Springs, Calif. 92262

[ * ] Notice: The portion of the term of this patent subsequent to Aug. 29, 1995, has been disclaimed.

[21] Appl. No.: 886,289

[22] Filed: Mar. 13, 1978

Related U.S. Application Data

[63] Continuation-in-part of Ser. No. 785,838, Apr. 10, 1977, Pat. No. 4,109,862.

[51] Int. Cl.[2] ..... B05B 17/06; F15C 1/16

[52] U.S. Cl. ..... 239/405; 137/808; 239/463; 239/590.3; 261/DIG. 48; 261/DIG. 78

[58] Field of Search ..... 239/102, 403, 405, 431, 239/434, 463, 466, 467, 472, 474, 475, 487, 488, 499, 500, 518, 524, 589, 590, 590.5, DIG. 20; 137/808, 811; 261/DIG. 48, DIG. 78

[56] References Cited

U.S. PATENT DOCUMENTS

| | | | |
|---|---|---|---|
| 3,064,619 | 11/1962 | Fortman | 239/102 |
| 3,226,029 | 12/1965 | Goodman et al. | 239/102 X |
| 3,232,267 | 2/1966 | Hughes | 239/102 X |
| 3,256,677 | 6/1966 | Boucher et al. | 239/102 X |
| 3,747,851 | 7/1973 | Conrad | 239/403 X |
| 3,756,515 | 9/1973 | Arnold | 239/524 |
| 3,778,038 | 12/1973 | Eversole et al. | 261/DIG. 78 X |
| 3,806,029 | 4/1974 | Hughes | 239/102 |
| 3,958,760 | 5/1976 | Rosenberg | 239/524 X |
| 4,109,862 | 8/1978 | Hughes | 239/102 |

FOREIGN PATENT DOCUMENTS

| | | | |
|---|---|---|---|
| 2201607 | 8/1972 | Fed. Rep. of Germany | 239/102 |
| 1104208 | 11/1955 | France | 239/403 |
| 263446 | 9/1970 | U.S.S.R. | 239/102 |

*Primary Examiner*—John J. Love
*Assistant Examiner*—Andres Kashnikow
*Attorney, Agent, or Firm*—Christie, Parker & Hale

[57] ABSTRACT

A flow passage having a restriction is connected between a fluid inlet and outlet. A bluff body such as a frustum or disc is disposed in the flow passage between the inlet and the restriction. The inlet is transverse to the axis of the flow passage. The bluff body is mounted on a rod extending through the flow passage. In one embodiment, a sphere is mounted on the end of the rod beyond the outlet. The rod may be hollow and have holes near the restriction for the purpose of liquid feed. As fluid entering the inlet passes the rod and bluff body to the restriction, a vortex is generated.

60 Claims, 10 Drawing Figures

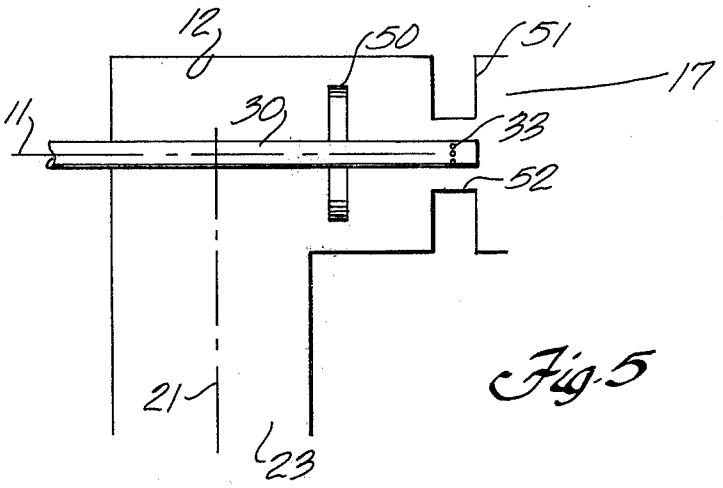
Fig. 5
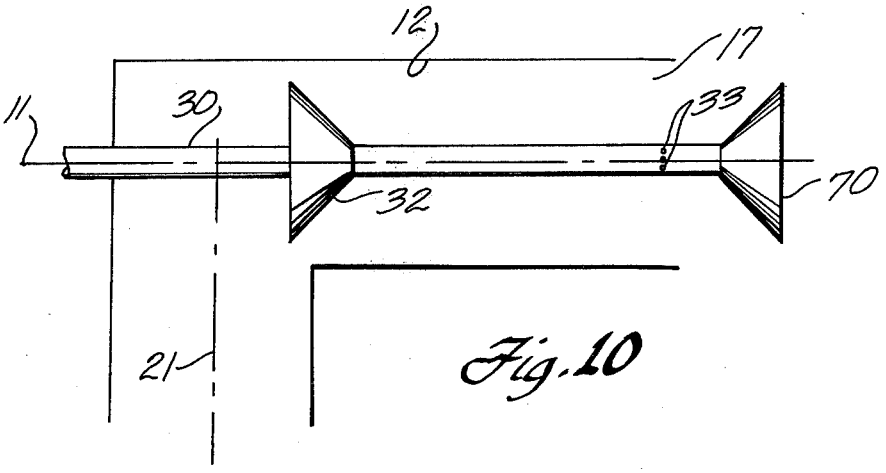
Fig. 10
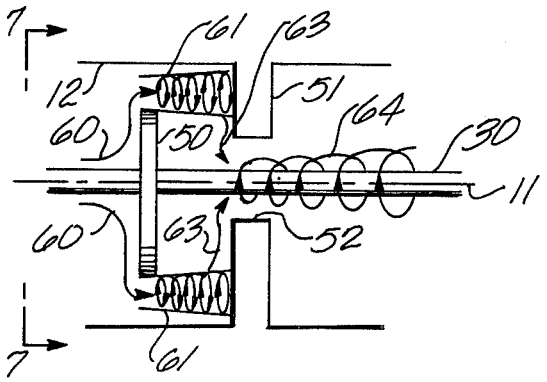
Fig. 6
Fig. 7
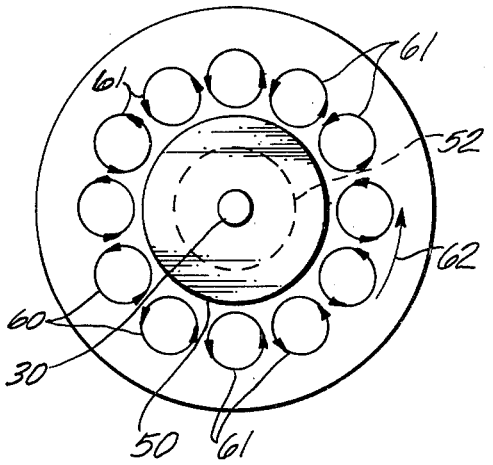

STABLE VORTEX GENERATING DEVICE

CROSS REFERENCE TO RELATED APPLICATIONS

This application is a continuation-in-part of application Ser. No. 785,838, filed on Apr. 10, 1977, now U.S. Pat. No. 4,109,862.

BACKGROUND OF THE INVENTION

This invention relates to fluid vortex generation and, more particularly, to an improved vortex generating device useful as an atomizer and/or a sonic energy transducer.

In one class of sonic energy transducer, sonic waves are generated by accelerating a gas to supersonic velocity in a nozzle. To achieve supersonic flow it has been necessary in the past to establish a large pressure drop from the inlet to the outlet of the nozzle. In order to produce sufficiently high energy levels for effective atomization and other purposes, prior art sonic energy transducers have used a resonator beyond the outlet of the supersonic nozzle, as disclosed in my U.S. Pat. No. 3,230,924, which issued Jan. 25, 1966, or a sphere in the diverging section of the supersonic nozzle, as disclosed in my U.S. Pat. No. 3,806,029, which issued Apr. 23, 1974.

SUMMARY OF THE INVENTION

By means of stable, efficient vortex generation, the invention produces supersonic flow and higher energy levels with a lower pressure drop than prior art devices employing supersonic nozzles. Resonators or spheres are not required to produce high energy levels with the invention, although they may be advantageously employed to increase the level of energization under some circumstances.

According to the invention, a flow passage is formed between an inlet and an outlet, which opens into a region at ambient pressure. A source of gas under pressure larger than the ambient pressure is connected to the inlet to induce gas movement through the flow passage along a flow axis. Still another feature of the invention is the placement of the bluff body in spaced stationary relationship upstream from the throat of the restriction. A rotational motion about the flow axis is imparted to the gas in the flow passage to form a plurality of tornado-like vortices arranged in a rotating ring about the flow axis. The plurality of vortices are combined into a single vortex rotating about the flow axis, which vortex is accelerated in the flow passage to supersonic velocity. As a result, three dimensional sound energy is emitted from the outlet into the region at ambient pressure.

A feature of the invention is the use of a bluff body such as a frustrum or flat disc to impart rotational motion to the gas in the flow passage. The bluff body is located in the flow passage between the inlet and the outlet. A restriction is formed in the flow passage downstream of the bluff body. Preferably, the inlet is transverse to the flow axis and may be positioned so the bluff body protrudes into the path of the inlet.

Another feature of the invention is the use of a rod extending along the length of the flow passage to impart rotational motion to the gas and stabilize the vortex generating process. In addition, the rod can also serve to support the frustum and to feed liquid to the restriction for atomization. In one embodiment, one end of the rod extends beyond the outlet and a sphere is mounted thereon.

BRIEF DESCRIPTION OF THE DRAWINGS

The features of specific embodiments of the best mode contemplated of carrying out the invention are illustrated in the drawings, in which:

FIG. 5 is a schematic side view of another embodiment of a vortex generating device incorporating the principles of the invention;

FIG. 6 is a side view depicting the gas flow pattern of a vortex generating device incorporating the principles of the invention;

FIG. 7 is an upstream end view depicting the gas flow pattern of a vortex generating device incorporating the principles of the invention.

FIG. 10 is a schematic side view of still another embodiment of a vortex generating device incorporating the principles of the invention.

DETAILED DESCRIPTION OF THE SPECIFIC EMBODIMENT

Figure 1:
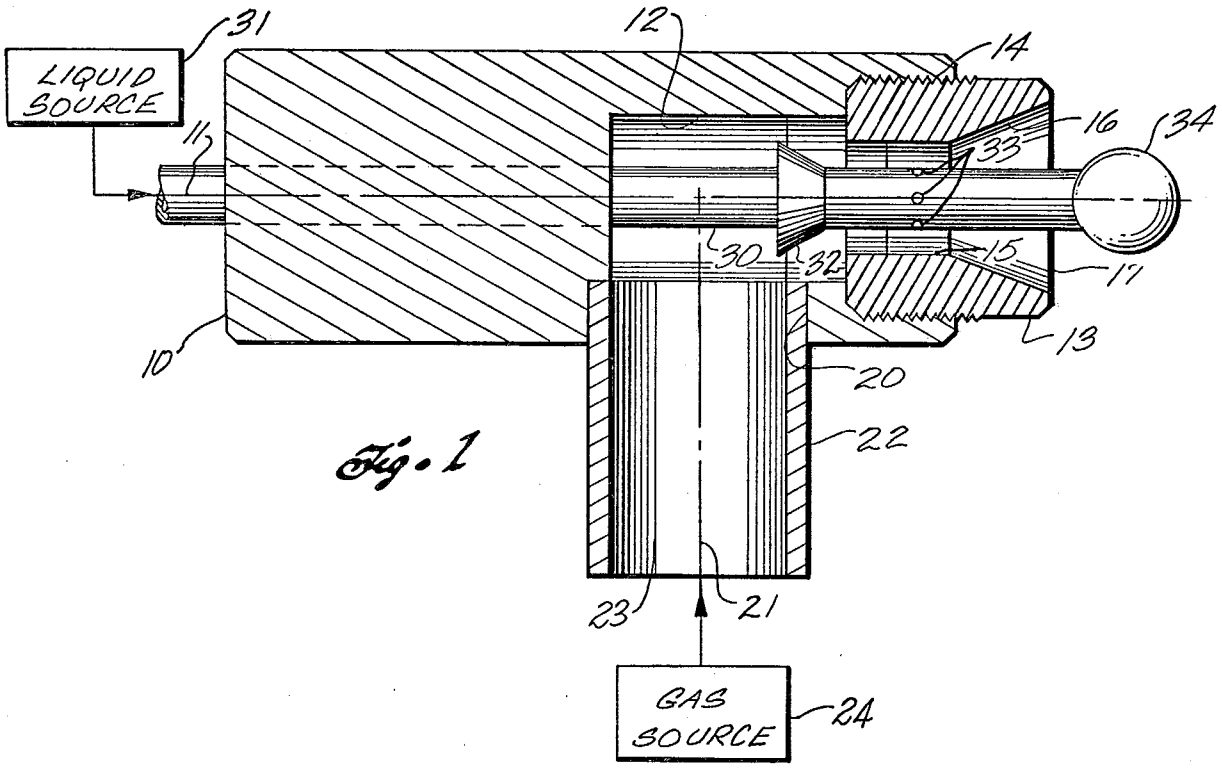
FIG. 1 is a side sectional view of one embodiment of a vortex generating device incorporating the principles of the invention.

In FIG. 1, a cylindrical transducer body 10 has a cylindrical axis 11. A cylindrical bore 12 is formed in one end of the body 10 in alignment with axis 11. A nozzle 13 is secured in a counterbore at the open end of bore 12 by a threaded connection 14. Adjacent to bore 12, nozzle 13 has a cylindrical section 15 having a smaller cross-sectional area than bore 12. A divergent section 16 joins section 15 to an outlet 17 of the transducer, which opens into a region at ambient pressure. Cylindrical section 15 and diverging section 16 are aligned with axis 11.

A cylindrical bore 20 formed in the side of body 10 meets bore 12. Bore 20 has a cylindrical axis 21 that intersects axis 11 at a right angle. Thus, axes 11 and 21 lie in the same plane. A cylindrical tube 22 fits inside bore 20, where it is secured to body 10 by welding, or the like. The inside of tube 22 serves as an inlet 23 of the transducer. As shown in FIG. 1, tube 22 extends straight into bore 12 so that inlet 23 opens straight into bore 12. A gas source 24 is connected to inlet 23. The gas from source 24 is under a pressure higher than the ambient pressure in the region into which outlet 17 opens.

A hollow rod 30 extends through body 10, including bore 12 and nozzle 13, in alignment with axis 11. For support and connection to a liquid source 31, rod 30 fits in a bore between bore 12 and the end of body 10 opposite to nozzle 13. A frustum 32 is mounted on rod 30 between inlet 23 and nozzle 13. Frustum 32 has a base facing away from nozzle 13, i.e., upstream, and an apex facing toward nozzle 13, i.e., downstream. As shown in FIG. 1, frustum 32 is axially positioned so its base and a portion only thereof are directly exposed to inlet 23, i.e., in a direct line of gas flowing through inlet 23 into bore 12. A plurality, e.g., four, liquid feed holes 33 are formed in rod 30 within cylindrical section 15. One end of rod 30 extends beyond outlet 17, where a sphere 34 is mounted thereon.

Figure 4:
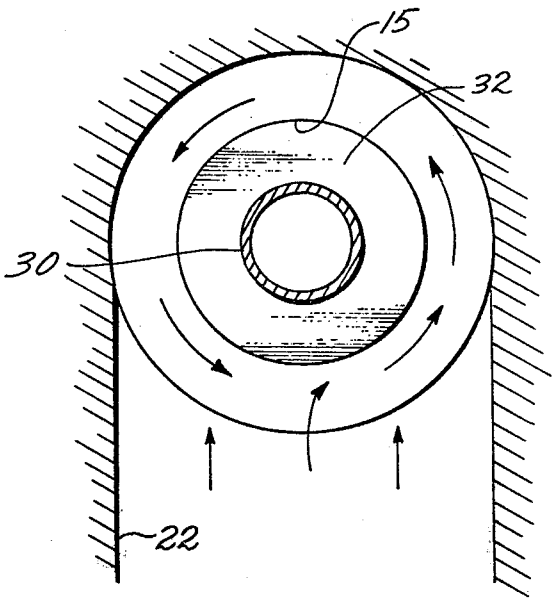
FIG. 4 is a schematic diagram showing the gas flow direction of the vortex generating device of FIG. 1 in a plane 90° to that of FIG. 3.
Figure 3:
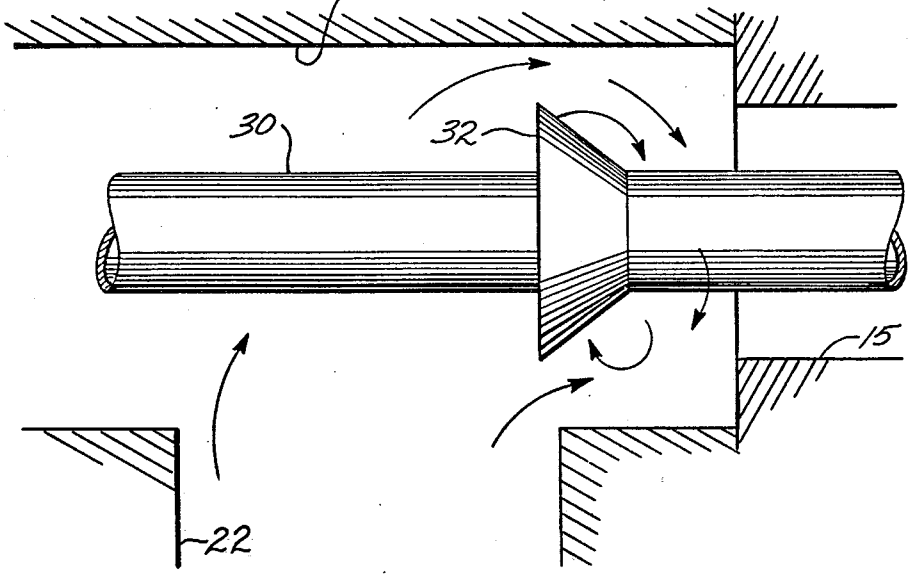
FIG. 3 is a schematic diagram showing the gas flow direction in the vortex generating device of FIG. 1.

In operation, the gas from source 24 flows through inlet tube 22, is interrupted by rod 30, and impinges upon only a portion of frustum 32 in a direction transverse to axis 11. Bore 12, cylindrical section 15, and diverging section 16 form a flow passage between inlet tube 22 and outlet 17. Nozzle 13, including cylindrical section 15 and diverging section 16, forms a restriction in this flow passage, and axis 11 serves as a common flow axis along and about which gas from source 24 flows to outlet 17. Cylindrical section 15 functions as a throat region of minimum cross-sectional area in the flow passage. Frustum 32 and, to a lesser extent, rod 30 impart a rotational motion about axis 11 to the gas, as illustrated in FIGS. 3 and 4. Consequently, a stable gas vortex flows through the flow passage from left to right as viewed in FIG. 1. The direction of rotation is counterclockwise, as viewed from left to right in FIG. 1, and its axis is parallel to the direction of flow, i.e., axis 11. This vortex produces at the inlet of cylindrical section 15 a subatmospheric pressure related to the superatmospheric pressure of source 24, i.e., the higher the superatmospheric pressure of source 24 the lower is the absolute pressure at cylindrical section 15, as absolute zero pressure is approached. The decrease in absolute pressure at cylindrical section 15 with increasing superatmospheric pressure of source 24 is approximately linear over a large range. As the superatmospheric pressure of source 24 is increased above this range, e.g., at about approximately 80 psig, the subatmospheric pressure at cylindrical section 15 levels off and then drops slightly. For very high pressure of source 24, e.g., above 80 psig, it is advantageous to put an orifice in inlet 23, which accelerates the gas impinging upon frustum 32 and maintains a low subatmospheric pressure at cylindrical section 15 as the source pressure rises further. The vortex produces by rotation strong centrifugal forces and an atomization effect not unlike that produced by a centrifuge. The vortex creates the subatmospheric pressure at cylindrical section 15; as the superatmospheric pressure of source 24 is increased, the vortex rotates faster, the subatmospheric absolute pressure at the center of the vortex drops, and the resultant energy builds up in a turbine-like manner. For each value of gas source pressure, there is a null point of minimum subatmospheric pressure along axis 11.

This vortex provides a sufficient pressure drop to establish and exceed the critical pressure ratio for supersonic flow between source 24 and cylindrical section 15 with a much lower value of gas source pressure than the prior art. The gas flowing through nozzle 13 is, therefore, accelerated to supersonic velocity while rotating about the common flow axis. As a result, a three dimensional sonic wave is produced beyond outlet 17. Sphere 34 produces a standing shock wave that interacts with the sonic wave to enhance the resultant sonic energy level. However, this sonic energy is not within the audible range. The intensity of the sonic energy is also believed to be enhanced by a beating, mixing, or heterodyning of the rather low frequency associated with the rotational component of the gas motion, i.e., the gas vortex flow about the common axis, and the rather high frequency associated with the translational component of the gas motion, i.e., the gas motion in the direction of the common flow axis. The low frequency component can be reduced in frequency by increasing the diameter of frustum 32. This increases the resulting number of beat frequencies.

Cylindrical section 15 provides an advantageous point for the introduction of a liquid to be atomized, such as gasoline, paint, chemical sprays, etc., because of the subatmospheric pressure created there by the gas vortex. Such location of the liquid feed produces a pumping action on source 31 due to the subatmospheric pressure, which draws the liquid into the gas stream through holes 33 and efficiently atomizes and/or vaporizes the liquid. The location of the feed holes at section 15 where subatmospheric pressure is created also promotes cavitation-like action of the liquid, which further enhances atomization by essentially boiling the liquid.

Rod 30 serves a number of functions. First, it serves as a drag member to aid in the formation of the gas vortex. Second, it increases the energy density in the flow passage by reducing the cross-sectional area. Third, it moves the bulk of the gas particles flowing through the flow passage to the circumference thereof to stabilize the boundary layer and produce a concentric shock pattern. Fourth, it focuses the vortically flowing gas into the restriction and serves as a guide for its passage to the end of the rod. Fifth, it serves as a conduit to carry liquid to cylindrical section 15. Sixth, it supports frustum 32 and sphere 34. The characteristics of the transducer can be changed by substituting a new rod having a different diameter for rod 30. However, the cross-sectional area of rod 30 is preferably between about 10% to 20% of the minimum cross-sectional area of the restriction, i.e., the cross-sectional area of cylindrical section 15. It has been found that when the cross-sectional area of rod 30 is much less than 10% or exceeds 50% of the minimum cross-sectional area of the restriction (i.e., the area of the restriction in the absence of the rod) operation of the device becomes impaired; therefore, these limits should not be exceeded.

Frustum 32 serves as a drag member to form the gas vortex along rod 30. The rotational motion of this gas vortex stabilizes the boundary layers within the flow passage, thereby promoting more efficient acceleration to supersonic velocity. The characteristics of the transducer can also be changed by substituting a frustum having a different base diameter and/or half-angle for frustum 32.

The subatmospheric pressure created at cylindrical section 15 is dependent upon the spacing between frustum 32 and the inlet of cylindrical section 15. Specifically, as frustum 32 approaches the inlet of cylindrical section 15, the subatmospheric pressure increases. This promotes atomization due to cavitation for very small effective orifice areas of the device. For small pressure drops and/or flow rates, atomization remains good because of the increased energy density at the annular orifice due to the angular velocity increase resulting from conservation of angular momentum. For example, good atomization takes place at a source pressure as low as 1 psig and a flow rate as low as 2 scf/hour.

The drag presented by frustum 32 is increased by directing the inlet gas toward frustum 32 at 90° to its axis rather than parallel to its axis. The protrusion of the base of frustum 23 into the path of inlet 32 creates a larger opening on the lower one-third of the circumference of frustum 32 than the remaining two-thirds. The resulting difference in flow resistance promotes the rotational motion of the gas. Thus, frustum 32 is an efficient dynamic drag member, because it converts the static pressure of the gas in inlet 23 into rotational motion in bore 12. The bottom one-third of the base of frustum 32 also functions as a knife edge in the gas flow stream entering bore 12 from inlet 23, thereby further enhancing the gas vortex and the sonic energy generation.

Sphere 34 also serves as a drag member and a shock reflector of the sonic waves emanating from outlet 17. Unlike the sphere within the nozzle shown in my U.S. Pat. No. 3,806,029, the position of sphere 34 beyond outlet 17 is not critical. In many applications, sphere 34 can be dispensed with entirely without adversely affecting the sonic energy level.

Figure 2:
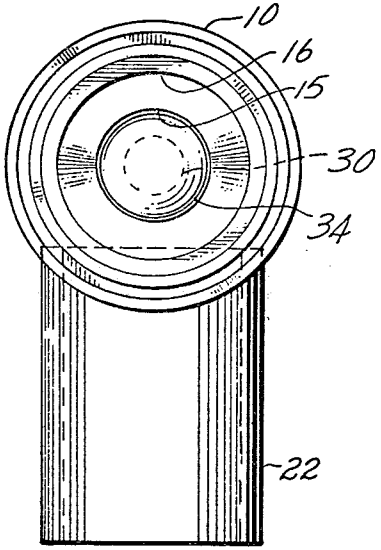
FIG. 2 is a front plan view of the vortex generating device of FIG. 1.

In a typical example, the device of FIGS. 1 and 2 would have the following dimensions: diameter of inlet 23-0.312 inch; diameter of bore 12-0.312 inch; length of bore 12-0.312 inch; diameter of section 15-0.200 inch; length of section 15-0.162 inch; diameter of section 16 at outlet 17-0.295 inch; half-angle of section 16-15° to axis 11; length of section 16-0.166 inch; diameter of rod 30-0.93 inch; base of frustum 32-0.200 inch; half-angle of frustum 32-34.6°; length of frustum 32-0.069 inch; diameter of sphere 34-0.1875 inch; spacing from outlet 17 to the center of sphere 34-0.100 inch; spacing from the base of frustum 32 to the inside surface of tube 22 along a line parallel to axis 11-0.020 inch.

In the embodiment of FIG. 5, the same reference numerals are used to identify elements in common with the vortex-generating device of FIG. 1. The vortex generating device shown schematically in FIG. 5 is the same as that shown in FIG. 1, except for the following: bore 12 extends all the way from inlet 23 to outlet 17 and nozzle 13 is absent; a thin flat circular disc 50 is mounted on rod 30 instead of frustum 32; a thin flat ring 52 having a central circular opening 52 is secured in bore 12 between disc 50 and outlet 17, as the restriction, instead of nozzle 13; sphere 34 is absent; and rod 30 is shortened to end on the downstream edge of ring 51. Disc 50 has a cylindrical edge surface. Rod 30, bore 12, disc 50, ring 51, and opening 52 are all concentric with axis 11. Disc 50 has been found to function as the full equivalent of frustum 32 under most circumstances. The thickness of disc 50 is not a significant factor, but is preferably less than one-half its diameter. (Similarly, the thickness of frustum 32 in FIG. 1 is also preferably less than one-half its base diameter). It is not necessary for a portion of disc 50 to be directly exposed to inlet 23, as with frustum 32, but inlet 32 should be as close as possible to disc 50 as shown in FIG. 5. As the distance between inlet 23 and disc 50 increases, the efficiency of the device drops off. Ring 51 has been found to function as the full equivalent of nozzle 13 under most circumstances. For supersonic flow, its thickness, i.e., the dimension along axis 11, should be at least one-half the diameter of disc 50. (Similarly, the length of the cylindrical section 15 in FIG. 1 is also preferably at least one-half the base diameter of frustum 32.) For most efficient operation, the distance between disc 50 and the upstream side of ring 51 is preferably approximately equal to the diameter of disc 50 or one-half the diameter of disc 50. When the spacing between disc 50 and ring 51 is less than the diameter of disc 50, but not one-half the diameter of disc 50, less efficient albeit satisfactory operation obtains. If the spacing between disc 50 and ring 51 is greater than the diameter of disc 50, the efficiency of the device falls off rapidy as the spacing increases, particularly above twice the diameter of disc 50. (Similarly, most efficient operation results in the embodiment of FIG. 1 when the distance between the base of frustum 32 and cylindrical section 15 is approximately equal to the base diameter of frustum 32 or one-half the base diameter of frustum 32.) The diameter of opening 52 controls the flow rate through the device. Disc 50 and ring 51 can be regarded as vortex lenses in that they "focus" the gas flowing through bore 12 to simulate a supersonic nozzle. If desired, rod 30 could be extended beyond outlet 17 for the purpose of supporting bluff bodies and/or a resonator in the manner described in my copending applications, Ser. No. 886,288, entitled "Vortex Generating Device with External Flow Interrupting Body", and Ser. No. 886,287, entitled "Vortex Generating Device with Resonator", both filed on even date herewith.

The essential requirement is to interrupt the gas flow entering bore 12 from inlet 23 with a bluff body. This bluff body may have any number of different shapes, but the most effective shapes have been found to be those presenting a flat circular surface to the gas flow-namely, frustum 32 in FIG. 1 and disc 50 in FIG. 5. In a typical example, the device of FIG. 5 would have the following dimensions: diameter of inlet 23-0.312 inch; diameter of bore 12-0.312 inch; length of bore 12-0.686 inch; diameter of disc 50-0.200 inch; thickness of disc 50-0.032 inch; diameter of opening 52 0.150 inch; thickness of ring 51-0.100 inch; distance between the upstream end of bore 12 and the upstream surface of disc 50-0.496 inch; distance between the downstream surface of disc 50 and the upstream surface of ring 51-0.200 inch; diameter of rod 30-0.093 inch; diameter of openings 33-0.032 inch; and length of rod 30 lying in bore 12-0.596 inch.

FIGS. 6 and 7 illustrate the gas flow pattern of the vortex generating device of FIG. 5. As the interrupted gas flow represented by arrows 60 passes over the flat upstream surface of disc 50 and around the edge thereof, a number of small tornado-like vortices 61 are formed in a ring coaxial with axis 11. Unlike the vortex shedding that normally occurs when a nonstreamlined body lies in a fluid stream, vortices 61 are quite stable and have axes parallel to the direction of flow, i.e., axis 11. Vortices 61 each increase in circumference as they move downstream, as illustrated in FIG. 6, and each rotate about their own axes in a counterclockwise direction looking downstream, as illustrated in FIG. 7. Vortices 61 thus have conical envelopes that tend to merge as they move downstream. The envelopes of vortices 61 also all rotate about axis 11 in a counterclockwise direction looking downstream, as illustrated by an arrow 62 in FIG. 7. The flat upstream surface of ring 51 interrupts the flow of vortices 61 causing the gas thereof to flow inwardly toward axis 11, as illustrated by arrows 62 in FIG. 6. Consequently, the gas of vortices 61 flows through opening 52 and blends together to form a single large vortex 64 which rotates about rod 30. To some extent, the small individual vortices survive the blending at opening 52 and are present in large vortex 64. As stated above, it is believed the described vortical flow pattern produces the subatmospheric pressure downstream of disc 50 when vortices 61 merge into single vortex 64 and pass through ring 51. A similar vortical flow pattern is produced by frustum 32 and the upstream face of nozzle 13 in FIG. 1. Measurements have shown the subatmospheric pressure within vortices 61 to be substantially smaller, i.e., two to three times, than the subatmospheric pressure within vortex 64. Thus, the gas forming the individual vortices 61 may be flowing at supersonic velocity even when gas forming the single vortex 64 is not flowing at supersonic velocity. The formation of the individual vortices 61 is an important part of the overall process. It appears that the subatmospheric pressure at the restriction is directly related to the number of individual vortices 61 formed. For a given annular cross-sectional area between bore 12 and disc 50, the most individual vortices 61 are formed on a bluff body presenting a circular surface, because a circle presents the largest perimeter for the formation of the individual vortices 61.

For most efficient operation of the device of FIG. 1 or the device of FIG. 5, it is preferable to follow several rules of design. The first rule is that the cross-sectional area of the annulus between frustum 32 (or disc 50) and the surface of bore 12 be at least 10% larger, and preferably 20% larger, than the minimum cross-sectional area of the restriction, i.e., the cross-sectional area of cylindrical section 15 (or opening 52). The second rule is that the annular space between the surface of bore 12 and frustum 32 (or disc 50) be as small as possible consistent with the first rule; the ratio of this space to the base diameter of frustum 32 should never exceed 30%, or, in other words, the ratio of the base diameter of frustum 32 to the diameter of the bore 12 should be at least 0.625. The third rule is that the circumference of frustum 32 (or disc 50) be as large as possible consistent with the first and second rules.

Figure 8:
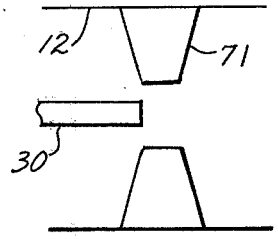
FIG. 8 is a schematic side view of a variation of the ring of FIG. 5.
Figure 9:
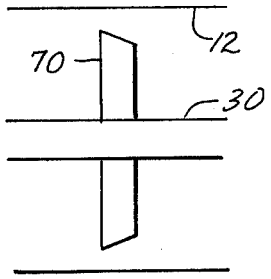
FIG. 9 is a schematic side view of a variation of the disc of FIG. 5.

FIG. 8 illustrates a modification of ring 51 of the embodiment of FIG. 5. Specifically, rather than having flat surfaces, a ring 71 has concave conical surfaces, which may aid in the vortex blending of the gas entering opening 52. FIG. 9 illustrates a modification of disc 50 of the embodiment of FIG. 5. Specifically, the edge of a disc 70, rather than being cylindrical, is chamfered or conical. In other words, the upstream face of disc 70 has a larger diameter than the downstream face thereof. If liquid to be atomized is fed through rod 30 and rod 30 stops at the restriction, as in FIG. 8, a single feed hole could be provided on the end of rod 30, i.e., so the opening in rod 30 faces downstream. In a specific example, the conical surface of ring 71 forms a half-angle of 60° with axis 11, and the conical surface of the disc 70 forms an angle of 15° with axis 11.

In the embodiment of FIG. 10 the same reference numerals are used to identify elements in common with the vortex generating device of FIG. 1. The vortex generating device shown schematically in FIG. 10 is the same as that shown in FIG. 1, except for the following: bore 12 extends all the way from inlet 23 to outlet 17 and nozzle 13 is absent; a frustum 70 that has a base facing away from frustum 32 and an apex facing toward frustum 32 is mounted on the end of rod 30 beyond outlet 17, instead of sphere 34; and liquid feed holes 33 are formed in rod 30 between outlet 17 and frustum 70. In this embodiment, frustum 70 functions as the restriction in the flow passage provided by bore 12 although frustum 70 is beyond outlet 16. This device does not produce as low a subatmospheric pressure as the devices of FIGS. 1 and 5, but it is an effective atomizer and is useful in a number of applications. As an alternative a nozzle such as shown in FIG. 1 or a ring such as shown in FIG. 5 could also be used in this embodiment in addition to frustum 70.

To date, the parts of the device have been machined from metal such as steel. However, it is believed that the invention will function to the same extent with molded plastic parts.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, although it is preferred for inlet 23 to be transverse to the flow axis, it could be aligned therewith as in conventional nozzles; although it is preferred to form the vortex in part with a frustum, the frustum could be eliminated leaving the rod to perform this function; the sphere beyond the outlet of the transducer could be eliminated in many cases without adverse consquences upon the energy level; although it is preferable to feed liquid to cylindrical section 15, liquid could be atomized at other points, e.g., at outlet 17, or if the transducer is not used for atomization, source 31 could be eliminated altogether; and although the disclosed form of the restriction is preferred, other types of restrictions could be utilized such as converging-diverging sections, converging-cylindrical-diverging sections, or a diverging section alone. It is contemplated in some applications that the ambient pressure in the region into which the outlet of the transducer opens is a subatmospheric pressure, i.e., in the intake manifold of an internal combustion engine; in such case, source 24 could be at atmospheric pressure, i.e., source 24 could be the atmosphere. It is also contemplated in some applications that the ambient pressure in the region into which the outlet of the device opens is superatmospheric pressure, i.e., in the middle of a fluidic control system; in such case good vortices appear at the outlet of the device, possibly better than when ambient is atmospheric pressure. It has been found that when a conduit is connected to the outlet of one of the described devices, the vortices generated by the devices survive the conduit and can be seen emanating therefrom; good atomization is also possible at the end of the conduit. The invention can also be used to energize liquids, i.e., source 24 could be a liquid rather than a gas. Further, the subatmospheric pressure created at the restriction can be used to actuate a process control valve or to draw in gas for mixing preparatory to combustion. Although embodiments of the invention having specified dimensions have been disclosed, the devices may be scaled up or down in size without a loss in effectiveness.

It has been observed the described device can function as a flowmeter in that the flow rate through the device is approximately a linear function of the pressure difference between the the gas source and the restriction. Thus, the flow rate can be measured by connecting the inlets of a differential pressure transmitter to the source inlet and the restriction, respectively. Further, the differential pressure can be utilized as a control signal to actuate some external equipment responsive to the flow rate through the device.

The rod could be extended out to a remote point, e.g., 5 to 10 inches from the outlet, for the purpose of atomizing at such remote point. It has been found that the rod serves to "conduct" the vortically flowing gas to the remote point.

What is claimed is:

1. A vortex generating device comprising:

a fluid inlet;

a fluid outlet;

a flow passage having a given cross-sectional area connected between the inlet and the outlet;

a restriction in the flow passage between the inlet and the outlet comprising a cylindrical section having a cross-sectional area smaller than the given cross-sectional area; and a stationary bluff body disposed in the flow passage between the inlet and the restriction, the bluff body having a flat surface facing upstream to interrupt fluid flow, the bluff body, the restriction, and the outlet, being aligned with a common flow axis and the inlet being aligned with an inlet axis that intersects the common flow axis at an angle.

2. The device of claim 1, in which the bluff body is a frustum having a base facing upstream and an apex facing downstream.

3. The device of claim 2, in which the inlet is positioned such that the base and a portion only of the frustum are exposed to the inlet.

4. The device of claim 3, in which the restriction additionally comprises a diverging section joining the cylindrical section to the outlet.

5. The device of claim 4 additionally comprising a rod aligned with the flow passage, the frustum being mounted on the rod.

6. The device of claim 5, in which the rod is hollow and has one or more holes near the restriction, the device additionally comprising a source of liquid to be atomized connected to the rod to feed the liquid to the restriction.

7. The device of claim 1, in which the inlet axis is transverse to the common flow axis.

8. The device of claim 7, in which the bluff body comprises a frustum having a base facing upstream and an apex facing downstream.

9. The device of claim 7, in which the bluff body comprises a circular disc.

10. The device of claim 1, in which the bluff body comprises a circular disc.

11. The device of claim 10, in which the circular disc has a cylindrical edge.

12. The device of claim 10, in which the circular disc has a chamfered edge, the diameter of the upstream face of the disc being larger than the diameter of the downstream face.

13. The device of claim 10, in which the restriction comprises a thin flat ring having a circular opening.

14. The device of claim 13, additionally comprising a rod aligned with the common flow axis in the flow passage, the disc being mounted on the rod.

15. The device of claim 14, in which the rod is hollow and has one or more holes near the restriction, the device additionally comprising a source of liquid to be atomized connected to the rod to feed the liquid to the restriction.

16. The device of claim 13, in which the distance between the disc and the ring is the diameter of the disc or one-half the diameter of the disc.

17. The device of claim 16, in which the thickness of the ring is at least one-half the diameter of the disc.

18. The device of claim 1, additionally comprising a rod extending along the flow passage, the bluff body being mounted on the rod.

19. The device of claim 18, in which the rod is hollow and has one or more holes near the restriction, the device additionally comprising a source of liquid to be atomized connected to the rod to feed the liquid to the restriction.

20. The device of claim 18, in which the cross-sectional area of the rod is less than 50% of the minimum cross-sectional area of the restriction.

21. The device of claim 20, in which the cross-sectional area of the rod is about 20% of the minimum cross-sectional area of the restriction.

22. The device of claim 1, in which the restriction additionally comprises a diverging section joining the cylindrical section to the outlet.

23. The device of claim 1, in which the restriction comprises a thin, flat ring having a circular hole.

24. The device of claim 1, in which the space between the bluff body and the surface of the flow passage is less than 30% of the distance across the flat surface of the body.

25. The device of claim 1, in which the cross-sectional area of the space between the surface of the flow passage and the bluff body is at least 10% larger than the minimum cross-sectional area of the restriction.

26. The device of claim 25, in which the cross-sectional area of the space between the bluff body and the surface of the flow passage is about 20% larger than the minimum cross-sectional area of the restriction.

27. The device of claim 1, additionally comprising a source of gas connected to the fluid inlet, the pressure difference between the source and the fluid outlet being such that gas from the source flowing through the flow passage from inlet to outlet forms vortices as it passes over the bluff body.

28. The device of claim 1, in which the inlet extends straight into the flow passage to open abruptly into the flow passage.

29. A vortex generating device comprising:

a flow passage aligned with a common flow axis;

a fluid inlet aligned with an axis transverse to the common flow axis and connected to one end of the flow passage;

a fluid outlet aligned with the common flow axis and connected to the other end of the flow passage;

a rod in the flow passage aligned with the common flow axis, the rod extending across the inlet so fluid flowing through the inlet is interrupted by the rod;

a bluff body mounted on the rod in the flow passage at the inlet to protrude into the path of the inlet; and a restriction in the flow passage between the bluff body and the outlet.

30. The device of claim 29, in which the bluff body comprises a frustum having a base facing upstream and an apex facing downstream.

31. The device of claim 29, in which the bluff body comprises a circular disc.

32. The device of claim 31, in which the disc has a cylindrical edge.

33. The device of claim 31, in which the edge of the disc is chamfered, the disc having an upstream face with a larger diameter than the downstream face.

34. The device of claim 31, in which the thickness of the disc is less than one-half the diameter of the disc.

35. The device of claim 31, in which the flow passage has a given cross-sectional area and the restriction comprises a thin, flat ring having a circular opening with a cross-sectional area smaller than the given cross-sectional area.

36. The device of claim 35, in which the distance between the disc and the ring is the diameter of the disc or one-half the diameter of the disc.

37. The device of claim 29, in which the space between the bluff body and the surface of the flow passage is less than 30% of the distance across the bluff body transverse to the flow axis.

38. The device of claim 29, in which one end of the rod extends beyond the outlet, the device additionally comprising a sphere mounted on the one end of the rod beyond the outlet.

39. The device of claim 29, in which one end of the rod extends beyond the outlet, the device additionally comprising a frustum mounted on the one end of the rod beyond the outlet, the apex of the frustum facing upstream and the base of the frustum facing downstream.

40. The device of claim 29, in which the cross-sectional area of the rod is less than 50% of the minimum cross-sectional area of the restriction.

41. The device of claim 40, in which the cross-sectional area of the rod is about 20% of the minimum cross-sectional area of the restriction.

42. The device of claim 29, in which the cross-sectional area between the bluff body and the surface of the flow passage is at least 10% larger than the minimum cross-sectional area of the restriction.

43. The device of claim 42, in which the cross-sectional area between the bluff body and the surface of the flow passage is about 20% larger than the minimum cross-sectional area of the restriction.

44. The device of claim 29, in which the rod is hollow and has one or more holes near the restriction, the device additionally comprising a source of liquid to be atomized connected to the rod to feed the liquid to the restriction.

45. The device of claim 29, in which the inlet axis intersects the common flow axis.

46. The device of claim 29, in which the inlet extends straight into the flow passage to open abruptly into the flow passage.

47. A vortex generating device comprising:

a fluid inlet aligned with an inlet axis;

a fluid outlet opening into a region at ambient pressure, the outlet being aligned with an outlet axis;

a flow passage connected between the inlet and the outlet, the flow passage having a flow axis lying in the same plane as the inlet and outlet axes;

a source of gas under pressure larger than the ambient pressure connected to the inlet to cause the gas to pass through the flow passage; and means for generating in the gas a vortex rotating about the flow axis, the generating means comprising a restriction having in alignment with the flow axis a throat region of minimum cross-sectional area in the flow passage between the inlet and the outlet and a stationary bluff body disposed in the flow passage in spaced relationship from the throat region.

48. The device of claim 47, in which the inlet axis intersects the flow axis at an angle.

49. The device of claim 48, in which the bluff body is disposed between the restriction and the inlet.

50. The device of claim 49, in which the throat region of the restriction comprises a cylindrical section.

51. The device of claim 50, in which the inlet axis is transverse to the flow axis.

52. A vortex generating device comprising:

a flow passage aligned with a common flow axis;

a fluid inlet aligned with an inlet axis lying in the same plane as the common flow axis and connected to one end of the flow passage;

a fluid outlet aligned with the common flow axis and connected to the other end of the flow passage;

a bluff body disposed in the passage between the inlet and the outlet in stationary relationship; and a restriction in the flow passage between the inlet and the outlet comprising a cylindrical section.

53. The device of claim 52, in which the bluff body has a flat surface facing upstream to interrupt fluid flow.

54. The device of claim 52, in which the bluff body is between the inlet and the restriction.

55. The device of claim 52, in which the bluff body is spaced from the cylindrical section.

56. A vortex generating device comprising:

a flow passage aligned with a common flow axis;

a fluid inlet aligned with an inlet axis lying in the same plane as the common flow axis and connected to one end of the flow passage;

a fluid outlet aligned with the common flow axis and connected to the other end of the flow passage;

a restriction in the flow passage between the inlet and the outlet, the restriction having a throat region of minimum cross-sectional area; and a bluff body disposed in the flow passage in spaced stationary relationship from the throat region.

57. The device of claim 56, in which the inlet axis is transverse to the flow axis.

58. The device of claim 56, in which the throat region is a cylindrical section.

59. The device of claim 56, in which the bluff body has a flat surface facing upstream to interrupt fluid flow.

60. The device of claim 56, in which the bluff body is between the inlet and the restriction.

* * * * *

UNITED STATES PATENT AND TRADEMARK OFFICE

CERTIFICATE OF CORRECTION

PATENT NO. : 4,189,101
DATED : February 19, 1980
INVENTOR(S) : Nathaniel Hughes

It is certified that error appears in the above-identified patent and that said Letters Patent are hereby corrected as shown below:

Column 1, line 43, after "axis." insert --The flow axis lies in the same plane as the inlet and outlet axes.--; delete "Still another feature of the invention"
line 44, delete "is the placement of the bluff body in spaced stationary"
line 45, delete "relationship upstream from the throat of the restriction."
Column 2, line 2, insert new paragraph --Still another feature of the invention is the placement of the bluff body in spaced stationary relationship upstream from the throat of the restriction.--

Column 5, line 37, "52" should be --51--;
line 48, "diameter)." should be --diameter.)--;
line 50, "32" second occurrence should be --23--.
Column 6, line 56, "62" should be --63--.

Signed and Sealed this

*Twenty-sixth* Day of *August 1980*

[SEAL]

*Attest:*

SIDNEY A. DIAMOND

*Attesting Officer*

*Commissioner of Patents and Trademarks*